US009550948B2

(12) United States Patent
Koseoglu et al.

(10) Patent No.: US 9,550,948 B2
(45) Date of Patent: Jan. 24, 2017

(54) SULFONE CRACKING USING SUPERCRITICAL WATER

(71) Applicants: Omer Refa Koseoglu, Dhahran (SA); Farhan M. Al-Shahrani, Thuwal (SA); Abdennour Bourane, Ras Tanura (SA)

(72) Inventors: Omer Refa Koseoglu, Dhahran (SA); Farhan M. Al-Shahrani, Thuwal (SA); Abdennour Bourane, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 15/148,033

(22) Filed: May 6, 2016

(65) Prior Publication Data

US 2016/0272900 A1 Sep. 22, 2016

Related U.S. Application Data

(63) Continuation of application No. 14/383,944, filed as application No. PCT/US2012/026446 on Feb. 24, 2012, now Pat. No. 9,353,318.

(60) Provisional application No. 61/479,447, filed on Apr. 27, 2011.

(51) Int. Cl.

| | |
|---|---|
| ***C10G 53/12*** | (2006.01) |
| ***C10G 1/00*** | (2006.01) |
| ***C10G 17/02*** | (2006.01) |
| ***C10G 19/02*** | (2006.01) |
| ***C10G 29/04*** | (2006.01) |

(Continued)

(52) U.S. Cl.

CPC ..... *C10G 53/12* (2013.01); *C10G 1/002* (2013.01); *C10G 17/02* (2013.01); *C10G 19/02* (2013.01); *C10G 29/04* (2013.01); *C10G 31/08* (2013.01); *C10G 53/10* (2013.01); *C10G 2300/202* (2013.01); *C10G 2300/805* (2013.01)

(58) Field of Classification Search

CPC ..... C10G 31/08; C10G 29/02; C10G 29/16; C10G 17/04; C10G 1/002; C10G 53/14; C10G 29/00; C10G 27/00; C10G 29/04; C10G 2300/1033; C10G 2300/202; C10G 2300/805

See application file for complete search history.

(56) References Cited

U.S. PATENT DOCUMENTS

| | | | | |
|---|---|---|---|---|
| 6,368,495 | B1 * | 4/2002 | Kocal | C10G 27/04 208/240 |
| 2008/0099374 | A1 * | 5/2008 | He | B01J 3/008 208/177 |
| 2008/0099376 | A1 * | 5/2008 | He | C10G 31/08 208/264 |

OTHER PUBLICATIONS

Katritsky et al, Aqueous High temperature Chemistry of Carbo and Heterocyles. Reactions of Aryl Sulfoxides and Sulfones in Sub- and Supercritical Water at 200-460 C, 1997, Energy and Fuels, 11, 150-159.*

(Continued)

*Primary Examiner* — Randy Boyer
*Assistant Examiner* — Juan Valencia
(74) *Attorney, Agent, or Firm* — Abelman, Frayne & Schwab

(57) ABSTRACT

The invention relates to a process for removing sulfur compounds from a hydrocarbon stream. The hydrocarbon stream is contacted with water, at supercritical conditions and also subjects an effluent hydrocarbon stream to separation techniques. The resulting hydrocarbon stream is substantially free of sulfur oxides, sulfoxides, and sulfones.

19 Claims, 1 Drawing Sheet

(51) Int. Cl.
*C10G 31/08* (2006.01)
*C10G 53/10* (2006.01)

(56) References Cited

OTHER PUBLICATIONS

Varga et al, Desulfurization of Aromaitc Sulfones with Fluorides in Supercritical Water, 2004, Energy and Fuels, 18, 287-288.*

* cited by examiner

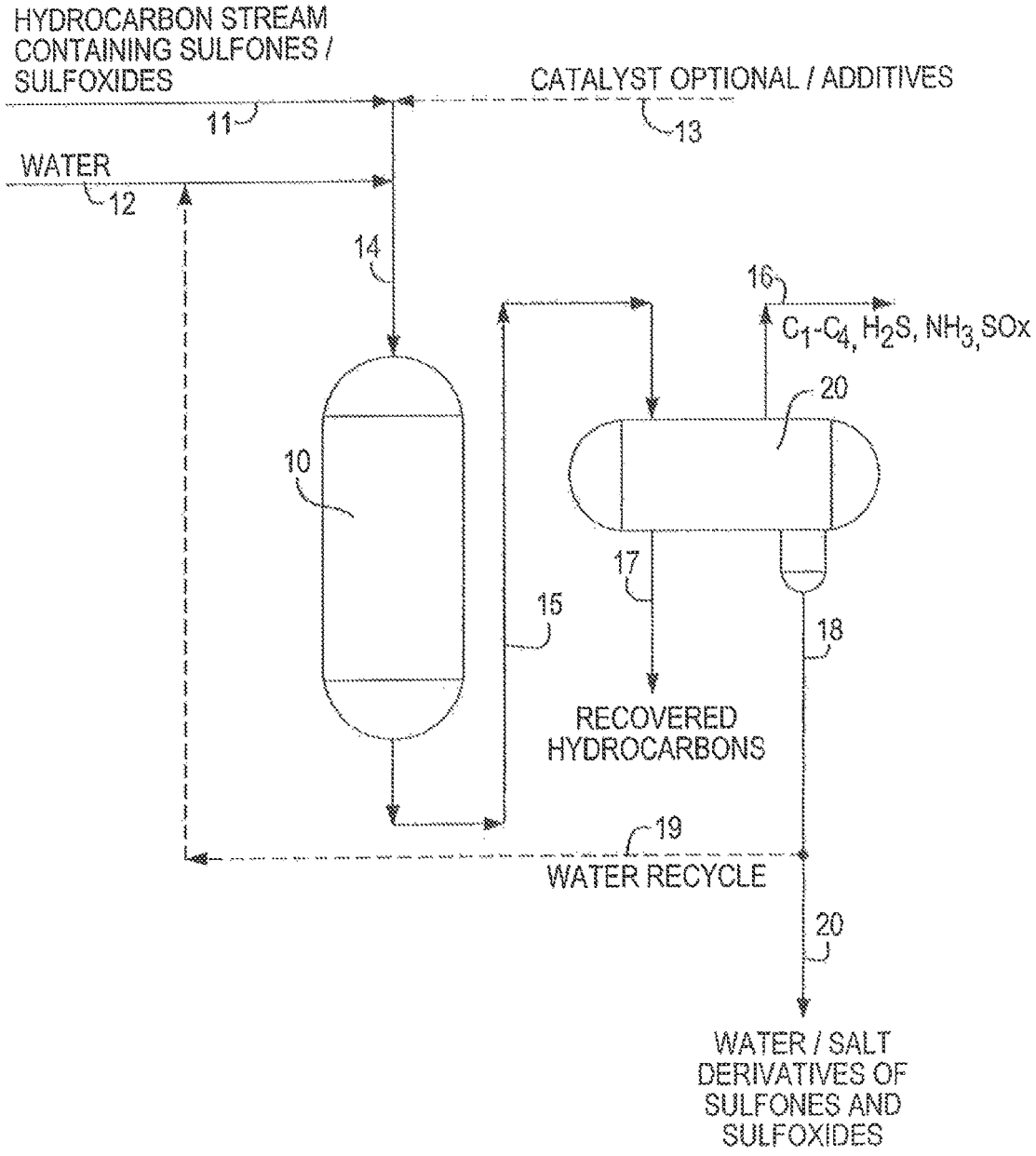
HYDROCARBON STREAM CONTAINING SULFONES / SULFOXIDES
11
CATALYST OPTIONAL / ADDITIVES
13
WATER
12
14
16
$C_1$-$C_4$, $H_2S$, $NH_3$, SOx
20
10
17
15
18
RECOVERED HYDROCARBONS
19
WATER RECYCLE
20
WATER / SALT DERIVATIVES OF SULFONES AND SULFOXIDES

SULFONE CRACKING USING SUPERCRITICAL WATER

FIELD OF THE INVENTION

This invention relates generally to a process for the removal of remaining sulfur compounds after oxidative desulfurization. More particularly, it relates to a process for the cracking or the destruction of sulfones, sulfoxides and mixtures thereof, present in hydrocarbon streams after oxidative desulfurization.

BACKGROUND OF THE INVENTION

The oxidative desulfurization of fossil fuels and/or its fraction is a well-known method in the prior art. The sulfur compounds oxidize with an oxidizing agent in the presence of catalyst(s) to form sulfoxides and then sulfones. The sulfones are separated from the oil by various separation methods including extraction, adsorption etc. The separated sulfones must be disposed of properly or converted into more useful chemicals. In this case, the sulfone associated hydrocarbon molecules need to be partially or fully recovered in order to minimize the loss of the raw material. The sulfone disposal option is not a preferred one because it will result in a large yield loss and will have a negative impact on the environment and process economics.

There are many processing routes and/or chemistry proposed for the destruction or conversion of sulfones formed during the oxidative desulfurization of fossil fuels and/or its fractions. These routes/chemistry include coking, fluid catalytic cracking, pyrolysis, hydrocracking, hydrolysis, etc.

The use of supercritical water treatment has been reported as a pretreatment and/or conversion of heavy oils and carbonaceous materials for further refinery processing.

A supercritical fluid is a material which can be either liquid or gas, used in a state above the critical temperature and critical pressure where gases and liquids can coexist. It possesses unique properties that are different from those of either gases or liquids under standard conditions.

A supercritical fluid has both the gaseous property of being able to penetrate anywhere, and the liquid property of being able to dissolve materials into their components. It offers the advantage of being able to change density to a great extent in a continuous manner. On this account, the use of water in the form of a supercritical fluid offers a substitute for an organic solvent in many fields of industry. It is attracting wide attention in processing, particularly in waste processing.

U.S. Pat. No. 6,887,369, which is incorporated herein by reference, discloses a process for treating a carbonaceous material that includes reacting the carbonaceous material and a process gas in supercritical water to at least hydrotreat and hydrocrack the carbonaceous material to form a treated carbonaceous material. The process is preferably carried out in a deep well reactor, but can be carried out in conventional surface-based reactors at a temperature of at least 705° F. and a pressure of at least 2500 psi. According to this invention, processes are provided for pretreating heavy oils and other carbonaceous materials, particularly to make such crude materials suitable for subsequent use in refinery processing.

Methods have been suggested for recovering liquid hydrocarbon fractions from various carbonaceous deposits utilizing water and in particular, supercritical water which results in increased yields of distillate and decreased levels of coke relative to straight pyrolysis. U.S. Pat. No. 3,051, 644, which is incorporated herein by reference, discloses a process for the recovery of oil from oil shale which involves subjecting the oil shale particles dispersed in steam to treatment with steam at temperatures in the range of from about 370° C. to about 485° C. and at a pressure in the range from about 1000 to 3000 psi. Oil from the oil shale is withdrawn in vapor form and admixed with steam.

Most fuels for transportation are derived from crude oils, which is the world's main source of hydrocarbons used as fuel and petrochemical feedstock. While compositions of natural petroleum or crude oils are significantly varied, all crudes contain sulfur compounds and, most also contain nitrogen compounds which may also contain oxygen, but the oxygen content of most, crude is low. Generally, sulfur concentration in crude oil is less than about 5 weight percent, with most crude oil having sulfur concentrations in the range from about 0.5 to about 1.5 weight percent. Nitrogen concentration is usually less than 0.2 weight percent, but it may be as high as 1.6 weight percent.

The crude oils are refined in oil refineries to produce transportation fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards.

Sulfur-containing organic compounds in fuels are a major source of environmental pollution. The sulfur compounds are converted to sulfur oxides during the combustion process and produce sulfur oxyacids and contribute to particulate emissions. Oxygenated fuel blending compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Purified diesel fuels prepared by chemical hydrotreating and hydrogenation to reduce their sulfur and aromatics contents, also causes a reduction in fuel lubricity. Diesel fuels of low lubricity may cause excessive wear of fuel pumps, injectors and other moving parts which come in contact with the fuel under high pressures. Mid distillates, a distillate fraction that nominally boils in the range 180° C. to 370° C., are used for fuel or a blending component of fuel for use in compression ignition internal combustion engines (Diesel engines) usually contain from about 1 to 3 percent by weight of sulfur. The specification for mid distillate fraction have been reduced to 10-50 parts per million weight (ppmw) levels from 3000 ppmw level since 1993 in Europe and United States.

In order to comply with these regulations for ultra-low sulfur content fuels, refiners will have to make fuels having even lower sulfur levels at the refinery gate so that they can meet the stringent specifications after blending at the gate.

Available evidence strongly suggests that ultra-low sulfur fuel is a significant technology enabler for catalytic treatment of diesel exhaust to control emissions. Fuel sulfur levels of below 15 ppm, likely, are required to achieve particulate levels below 0.01 g/bhp-hr. Such levels would be very compatible with catalyst combinations for exhaust treatment now emerging, which have shown the capability of achieving emissions of around 0.5 g/bhp-hr. Furthermore, NOx trap systems are extremely sensitive to fuel sulfur and available evidence suggests that they would need sulfur levels below 10 ppm to remain active.

In light of ever-tightening sulfur specifications for transportation fuels, sulfur removal from petroleum feedstocks and products will become increasingly important in years to come.

Low pressure conventional hydrodesulfurization (HDS) processes can be used to remove a major portion of the sulfur from petroleum distillates for the blending of refinery transportation fuels. These units, however, are not efficient to effect sulfur removal from compounds where the sulfur atom is sterically hindered as in multi-ring aromatic sulfur compounds. This is especially true where the sulfur heteroatom is hindered by two alkyl groups (e.g., 4,6-dimethyldibenzothiophene). These hindered dibenzothiophenes predominate at low sulfur levels such as 50 to 100 ppm. Severe operating conditions (i.e., higher hydrogen partial pressure, temperature, catalyst volume) must be applied to remove the sulfur from these refractory sulfur compounds. The increase of hydrogen partial pressure can only be done by increasing the recycle gas purity. Otherwise, new grassroots units must be designed, which is a costly option. The use of severe operating conditions results in yield loss, less catalyst cycle and product quality deterioration (e.g., color).

In order to meet ever more strict specifications in the future, such hindered sulfur compounds will also have to be removed from distillate feedstocks and products. This need drives the efforts to develop new non-conventional process technologies. Oxidation is one of the known methods to convert sulfur to its oxide form. The oxidized sulfur compounds are then removed by means of extraction or adsorption.

The sulfur compounds removed by extraction and/or adsorption contain sulfoxides and sulfones, mainly sulfones. Sulfoxides contain one oxygen atom on the sulfur, which is bonded to two carbon atoms, whereas sulfones contain two oxygen atoms on the sulfur atom, which is bonded to two carbon atoms as well. Because sulfoxides and sulfones are in the hydrocarbon structure, there is a yield loss if these two products are simply disposed off. If the carbon-sulfur bond is broken and sulfur is separated from the hydrocarbon structure, the hydrocarbons may be recovered from the sulfoxides and/or sulfones, increasing the oxidative desulfurization yield.

In U.S. Pat. No. 3,595,778, which is incorporated herein by reference, after oil (Tb>280° C.) is been oxidized with ozone (O/S=1.9), over a heterogeneous catalyst $V_2O_5$—$P_2O_5$/kieselghur or a homogeneous catalyst of group IV to VI-B metals, the oxidized sulfur compounds are then treated thermally at 150° C.-400° C. or with a base (KOH) at 200° C.-370° C. or by HDS to recover the hydrocarbon.

In U.S. Pat. No. 6,368,495, which is incorporated herein by reference, a hydrotreated diesel fuel is oxidized at 40° C.-120° C. and P=0.5-15 atm over a metal catalyst from Mo, W, Cr, V, Ti supported on a molecular sieve or an inorganic metal oxide using an oxidizing agent selected from the group of alkyl hydroperoxide, peroxides, peracetic acid, $O_2$ and air. Sulfone compounds present in the fuel (no separation) are then removed using a decomposition catalyst such as acid catalysts e.g. ZSM-5, mordenite, Alumina, $SiO_2$—$ZrO_2$ or basic catalysts e.g. MgO, hydrotalcite at 350° C.-400° C. and 5-10 atm.

In WO03/014266 A1, which is incorporated herein by reference, the hydrocarbon stream is first oxidized at 90° C.-105° C. and P=1 atm for a period of time up to about 15 minutes using an aqueous solution of $H_2O_2$ and formic acid. After separating the oxidizing solution a hydrodesulfurization of the stream containing the oxidized sulfur compounds is then hydrotreated at milder conditions than the ones used in conventional hydrodesulfurization.

In a 2004 article in *Energy and Fuels,* 18, 287-288, T. R. Varga et al. disclosed that sulfones are converted in the presence of fluoride ions. In the article entitled Desulfurization of Aromatic Sulfones with Fluorides in Supercritical Water, the fluorides KF and NaF were used to convert sulfones in supercritical water. These reactions, however, were based only on model compounds.

A 1997 article by Katrizky et al in *Energy and Fuels*, (II (1), pp. 150-159), entitled Aqueous High-Temperature Chemistry of Carbo and Heterocycles 28.1 Reaction of Aryl Sulfoxides and Sulfones in Sub and Supercritical Water at 200-460° C., discloses a high conversion rate for specific sulfones at supercritical conditions in the presence of formic acid and sodium formate. The sulfone conversion reactions were, however, based only on model compounds. Considering the thousands of other molecules in the oil matrix, the impact of these compounds in the oil matrix is not accounted for.

SUMMARY OF THE INVENTION

The present invention provides a process employing supercritical water to convert oxides of sulfur, sulfones and sufoxides into their salt derivatives and $SO_x$, wherein x is 2 or 3 from the hydrocarbon stream obtained from the oxidative desulfurization, which includes the steps of:

a) contacting the hydrocarbon stream with water in a reactor at supercritical water conditions; and, b) subjecting an effluent hydrocarbon stream to a vapor/liquid/liquid separation whereby a hydrocarbon fraction substantially free of oxides of sulfur, sulfones and water-containing salts and derivatives of oxides of sulfur is obtained.

In the process of the present invention, supercritical water is employed to break or crack the carbon-sulfur bond present in sulfones and sulfoxides, and mixtures thereof, which have been recovered from the oxidative desulfurization of whole crude oil or its fractions.

In one aspect of the present invention, the target is sulfones, sulfoxides and mixtures thereof, which have a boiling point in the range of about 180° C. to about 1500° C.

In another aspect of the present invention, and in contradistinction to the teachings of the prior art, particularly U.S. Pat. No. 6,887,369, adverted to previously, heavy oils and other related materials are treated with a reducing gas in a supercritical water environment to cause hydrocracking of the crude materials. The use of a deep-well reactor for reactions with reducing gases in a supercritical water environment produces hydrocracking in large volume and more economically than is conventionally available using surface-based supercritical water reactors.

BRIEF DESCRIPTION OF THE DRAWINGS

FIG. 1 is a flow diagram of the process of the present invention.

DETAILED DESCRIPTION OF THE INVENTION

The present invention comprehends a process to convert hydrocarbon streams containing oxides of sulfur, sulfones and sulfoxides. The process includes the following steps:

a) contacting the hydrocarbon stream with water in a reactor at supercritical water conditions in the absence of a catalyst or in the presence of a catalyst or additive; and, b) subjecting the effluent hydrocarbon stream to a vapor/liquid/liquid separator to obtain a hydrocarbon fraction free of oxides of sulfur, SOx and water containing salts and derivatives of oxides of sulfur.

In the process of the present invention, sulfones and sulfoxides and mixtures thereof are recovered from oxidative desulfurization by extraction and/or adsorption and/or absorption and/or membrane separation and/or distillation and/or solvent deasphalting and/or filtration and/or phase separation and are contacted with supercritical water either in the presence or absence of a catalytic system to break the carbon-sulfur bond.

The sulfoxides and/or sulfones may be derivatives of aliphatic sulfides, aromatic sulfides and mercaptans having a boiling point above 180° C. and up to about 1500° C.

The sulfoxides and/or sulfones may be derived from feedstocks, which may be whole crude oil or its fractional distillates boiling between 36° C. and 370° C. or residues boiling above 370° C. or hydrocarbons from intermediate refinery processing units, such as coking gas oils, FCC cycle oils, deasphalted oils, bitumens from tar sands and/or its cracked products, coal liquids.

Referring now to the drawing (FIG. 1), there is schematically illustrated an embodiment suitable for practicing the invention that includes two major vessels that are functionally described as supercritical water reactor vessel 10 and vapor/liquid/liquid separator vessel 20. All other process equipment, such as pumps, heat exchangers, flash vessels and valves are not shown in the drawing FIGURE.

In a particularly preferred embodiment, all of the vessels are operated as components in a continuous process. The hydrocarbon stream containing oxidized sulfur products including sulfoxides and sulfones feedstream 11, water 12 and the optional catalyst or additives 13 are combined and the combined feedstream 14 is fed to the supercritical water reactor vessel 10. The supercritical water reactor vessel 10 can be operated as an ebullated-bed reactor, a fixed-bed reactor, a tubular reactor, a moving-bed reactor or a continuous stirred-tank reactor.

The supercritical water reactor effluents stream 15 is then transferred to the vapor/liquid/liquid separator 20 to separate and recover the reaction products $SO_x$, wherein x is 2 or 3 and other hetero-containing gases, $H_2S$ and $NH_3$ stream 16, hydrocarbons 17 and water containing salt derivatives of sulfones and sulfoxides 18. The recovered water stream 19 can be recycled back to the supercritical water reactor or bled/rejected from the process stream 20.

The reaction with supercritical water may take place in the presence or absence of a catalytic system. The catalysts which can be used may be homogeneous or heterogeneous catalysts, which may include one or a combination of elements from Groups IVB, V and VI of the Periodic Table. The catalysts may be metals or dispersed on support material, with the preferred catalyst being molybdenum.

The support material may be silica-alumina, alumina, natural or synthetic zeolites, or activated carbon.

The reactors, if more than one, may be arranged in series or parallel and may contain different types of catalysts/additives or may be operated at different water-to-oil ratios.

The reactions are carried out at temperatures above supercritical conditions, namely, in the range of about 380° C., to about 600° C., and at a pressure range of about 220 bars to about 450 bars.

The residence time can be about 1 minute to about 600 minutes, with a preferred residence time of about 5 minutes to about 120 minutes, with a residence time of about 10 minutes to about 60 minutes being preferred.

The oil-to-water volume ratio can be about 1:5, with a ratio of about 1:2 being preferred and a ratio of about 1:1 being especially preferred.

Exemplary of the sulfones and sulfoxides which are present in crude oil fractions, but not limited thereto, are sulfones and sulfoxides of thiols, sulfides, benzothiophene, dibenzothiophene, naphthothiophene, naphthobenzothiophene, benzonaphthothiopene and their alkylated derivatives.

While the cracking mechanism employing supercritical water is not known with certainty, it is postulated that hydrogen is generated at supercritical water conditions, which minimizes coke formation and enhances the cracking reactions, resulting in the stabilization of the free radicals which are formed.

The sulfone cracking of the present invention may take place optionally in a basic medium, such as fluorides, or in an acidic medium using solid or liquid acids, such as formic acid.

Fluoride ion is known to be an efficient and strong base for use in organic reactions, if employed in dry aprotic solvents. However, the hydrogen bond of protic solvents usually serve to mask the fluoride ion by a specific solution which makes the fluoride ion a weak base. Water at elevated temperatures (>250° C.), behaves like an organic aprotic solvent. Its density, dielectric constant, Hildebrand solubility parameter and hydrogen bonding structure decrease significantly. Therefore, water at high temperatures becomes more compatible for organic reactions.

While only certain embodiments have been set forth, alternatives and modifications will be apparent from the foregoing to those skilled in the art. Such alternatives and modifications are considered to be equivalents and within the spirit and scope of the appended claims.

What is claimed is:

1. A process for converting oxides of sulphur, sulfones and sulfoxides in a hydrocarbon stream into their salt derivatives and $SO_x$ gases, wherein x is 2 or 3, comprising:

a) contacting said hydrocarbon stream with water, at supercritical water conditions in a reaction zone of a reactor, to form an effluent stream which contains said $SO_x$ gases, said hydrocarbon stream and water being combined at a volume ratio of from about 1:5 to about 1:1, b) transferring said effluent stream to a separator, and c) separating said $SO_x$ gases from said effluent stream.

2. The process of claim 1, comprising adding a molybdenum catalyst to said reaction zone.

3. The process of claim 1, comprising reacting said hydrocarbon stream and water at supercritical water conditions in a basic medium.

4. The process of claim 3, comprising reacting said hydrocarbon stream and water at supercritical water conditions in the presence of fluoride ions.

5. The process of claim 4, wherein said fluoride ions are obtained from at least one alkali metal compound of Group IA of the Periodic Table.

6. The process of claim 1, comprising reacting said hydrocarbon stream and water at supercritical water conditions in an acidic medium.

7. The process of claim 6, wherein said acid medium is liquid or solid.

8. The process of claim 7, comprising reacting said hydrocarbon stream and water at supercritical water conditions in the presence of formic acid.

9. The process of claim 1, wherein said sulfones, sulfoxides, and oxides of sulfur, have a boiling point in the range of from about 180° C. to about 1500° C.

10. The process of claim 1, wherein residence time in said reaction zone is from about 1 minute to about 600 minutes.

11. The process of claim 10, wherein the residence time is from about 5 minutes to about 120 minutes.

12. The process of claim 11, wherein the residence time is from about 10 minutes to about 60 minutes.

13. The process of claim 1, wherein the hydrocarbon stream/water volume ratio is 1:5.

14. The process of claim 1, wherein the hydrocarbon stream/water volume ratio is 1:2.

15. The process of claim 1, wherein the hydrocarbon stream/water volume ratio is 1:1.

16. The process of claim 1, wherein said reaction zone is selected from the group consisting of a batch, fixed-bed, ebullated-bed, moving-bed and a slurry-bed reactor.

17. The process of claim 1, wherein the hydrocarbon stream is whole crude oil, synthetic crude oil, bitumen, oil shale, coal liquid, a refined intermediate or a final product.

18. The process of claim 2, wherein the molybdenum catalyst is supported on a material selected from the group consisting of silica-alumina, alumina, natural or synthetic zeolites and activated carbon.

19. The process of claim 2, comprising reacting said hydrocarbon stream and water in more than one reactor, more than one reactor being arranged in series or parallel and each of said reactors containing a different catalyst.

* * * * *